US009214769B2

(12) United States Patent
MacDougall

(10) Patent No.: US 9,214,769 B2
(45) Date of Patent: Dec. 15, 2015

(54) ELECTRICAL PLUG CONNECTOR

(71) Applicant: ADVANCED-CONNECTEK INC., New Taipei (TW)

(72) Inventor: Alan Robert MacDougall, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 14/565,103

(22) Filed: Dec. 9, 2014

(65) Prior Publication Data

US 2015/0171571 A1 Jun. 18, 2015

(30) Foreign Application Priority Data

Dec. 13, 2013 (TW) ..... 102223655 U

(51) Int. Cl.
*H01R 29/00* (2006.01)
*H01R 13/703* (2006.01)
*H01R 24/62* (2011.01)

(52) U.S. Cl.
CPC ..... *H01R 13/7032* (2013.01); *H01R 24/62* (2013.01)

(58) Field of Classification Search
CPC ..... H01R 3/00; H01R 13/7031; H01R 24/28
USPC ..... 439/188, 489, 660; 361/679.01; 385/78
See application file for complete search history.

(56) References Cited

U.S. PATENT DOCUMENTS 3,226,496 A * 12/1965 Seabury, Jr. ..... H01H 1/36 200/11 K
6,083,020 A * 7/2000 Cheng ..... H01Q 1/242 200/51.1
6,139,344 A * 10/2000 Wang ..... H01R 13/2421 200/51.1
6,244,908 B1 * 6/2001 Hammond ..... H01R 13/7031 200/51.03
6,837,725 B1 * 1/2005 Gordon ..... H01R 29/00 200/51.1
6,846,996 B2 * 1/2005 Kent ..... A61N 1/048 200/276.1
6,945,824 B1 * 9/2005 Li ..... H01R 13/26 439/660
7,588,466 B2 * 9/2009 Blasko ..... B60L 11/1818 320/111
7,988,499 B2 * 8/2011 Lin ..... H01R 12/724 439/701
8,206,174 B2 * 6/2012 Ko ..... H01R 13/703 439/489
2004/0129551 A1 * 7/2004 Kent ..... A61N 1/048 200/520
2007/0049119 A1 * 3/2007 Fujimoto ..... H01R 9/03 439/607.41
2007/0072491 A1 * 3/2007 Huang ..... H01R 27/00 439/660
2010/0136848 A1 * 6/2010 Lin ..... H01R 12/724 439/701
2012/0113573 A1 * 5/2012 Ko ..... H01R 13/641 361/679
2012/0114288 A1 * 5/2012 Wu ..... G02B 6/3817 385/78
2012/0115359 A1 * 5/2012 Ko ..... H01R 27/02 439/578

* cited by examiner

*Primary Examiner* — Abdullah Riyami
*Assistant Examiner* — Nader J Alhawamdeh
(74) *Attorney, Agent, or Firm* — Muncy, Geissler, Olds & Lowe, P.C.

(57) ABSTRACT

A switching device of electrical plug connector includes a plug body, a circuit board and a switching member. The plug body includes a connecting shell and an inserting space. The circuit board is disposed at the plug body and connected to a plurality of conductive plates. The switching member is connected to the circuit board and includes a transmission bar, a contact plate and an elastic member. The transmission bar passes through the circuit board; one end of the transmission bar is disposed in the inserting space. The contact plate is disposed adjacent to the conductive plates and connected to another end of the transmission bar. The elastic member sleeves on the transmission bar. When an electrical receptacle connector inserts into the connecting shell, one end of the transmission bar is abutted to drive another end of the transmission bar moving, thereby connecting the contact plate with the conductive plates.

10 Claims, 6 Drawing Sheets

100

ELECTRICAL PLUG CONNECTOR

CROSS-REFERENCES TO RELATED APPLICATIONS

This non-provisional application claims priority under 35 U.S.C. §119(a) on Patent Application No. 102223655 filed in Taiwan, R.O.C. on 2013 Dec. 13, the entire contents of which are hereby incorporated by reference.

FIELD OF THE INVENTION

The disclosure relates to an electrical plug connector.

BACKGROUND

Currently, electrical devices such as tachograph devices, satellite navigation systems, cameras, and mobile communicating devices (namely, mobile phones), have multiple functions and bring convenience for people in daily life, enabling people to obtain the newest information wherever they are, through these devices.

Generally, the electrical device is operated under the supply of the power source assembled therein; once the power source lacks power, the electrical device is connected with the supply mains via a connecting cable.

Taking the vehicle charger as an example, two ends of the vehicle charger are respectively the vehicle charging connector and the USB connector, so that the vehicle charging connector is inserted into the inserting hole of the cigarette lighter, and the USB connector is connected to the electrical device for charging the electrical device. However, when drinks or water are spilled onto the USB connector, terminals, circuit boards or other electrical components in the USB connector will short-circuit since the vehicle charging connector is electrified (namely, the vehicle charging connector is connected with the cigarette lighter).

SUMMARY OF THE INVENTION

In view of this, the disclosure provides an electrical plug connector capable of being switched between a connection state and a disconnection state, so that the drawback described above can be solved.

The disclosure provides an electrical plug connector including a plug body, a circuit board and a switching member. One side of the plug body includes a connecting shell and an inserting space in the connecting shell. The circuit board is disposed at the plug body and is connected to a plurality of conductive plates. The switching member is connected to the circuit board and includes a transmission bar, a contact plate and an elastic member. The transmission bar passes through the circuit board, one end of the transmission bar is disposed in the inserting space, the contact plate is disposed adjacent to the conductive plates and connected to another end of the transmission bar. The elastic member is sleeved on the transmission bar. When an electrical receptacle connector is inserting into the connecting shell, one end of the transmission bar is abutted so as to drive another end of the transmission bar to move, so that the contact plate of another end of the transmission bar is connected with the conductive plates.

As described, when the electrical plug connector is not connected with the electrical receptacle connector, the contact plate of the switching member is not connected with the conductive plates so that the electrical plug connector is in the disconnection state, and the short-circuit problem does not occur upon spilling liquid on the electrical plug connector in which the connecting cable thereof is electrified. Additionally, when the electrical receptacle connector is inserting into the connecting shell, one end of the transmission bar is abutted so as to drive the contact plate of another end of the transmission bar to connect with the conductive plates, so that the electrical plug connector is in the connection state. Furthermore the stopping ring is disposed in the through hole of the circuit board and sleeves with the transmission bar so as to block water or liquid entering into the electrical plug connector through the through hole thereby providing a function of waterproofing.

The detailed features and advantages of the disclosure are described below in great detail through the following embodiments, the content of the detailed description is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein.

DETAILED DESCRIPTION

Figure 1:
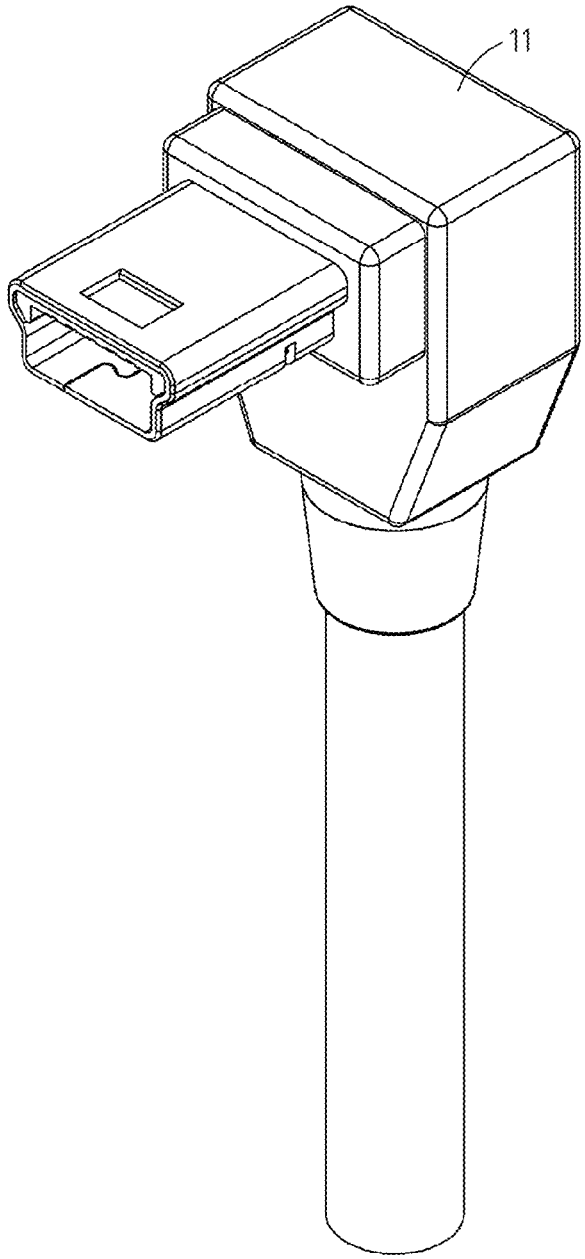
FIG. 1 is a perspective view of an electrical plug connector of the disclosure.
Figure 2:
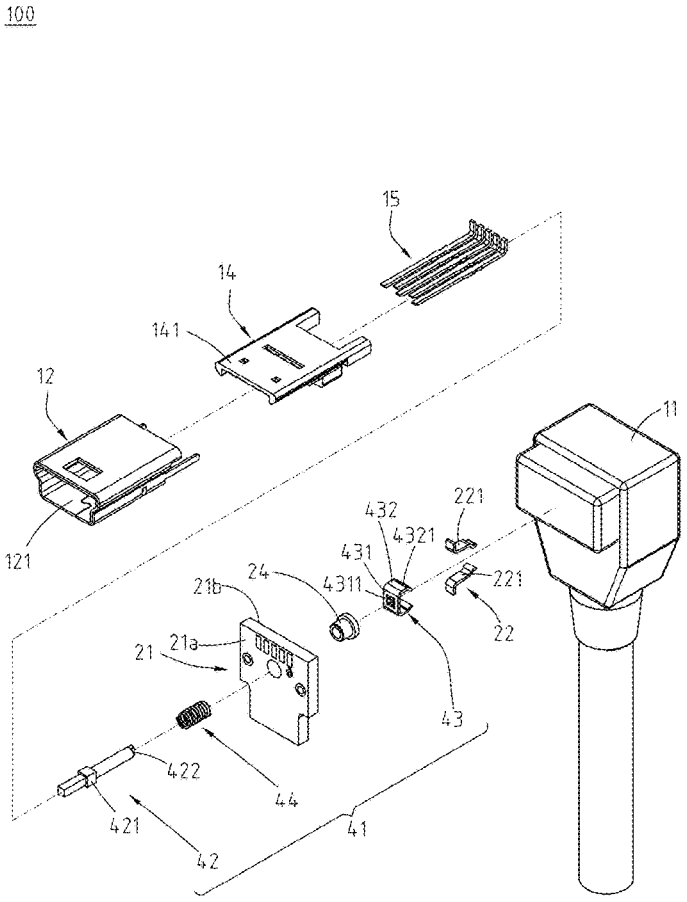
FIG. 2 is an exploded view of the electrical plug connector of the disclosure.
Figure 3:
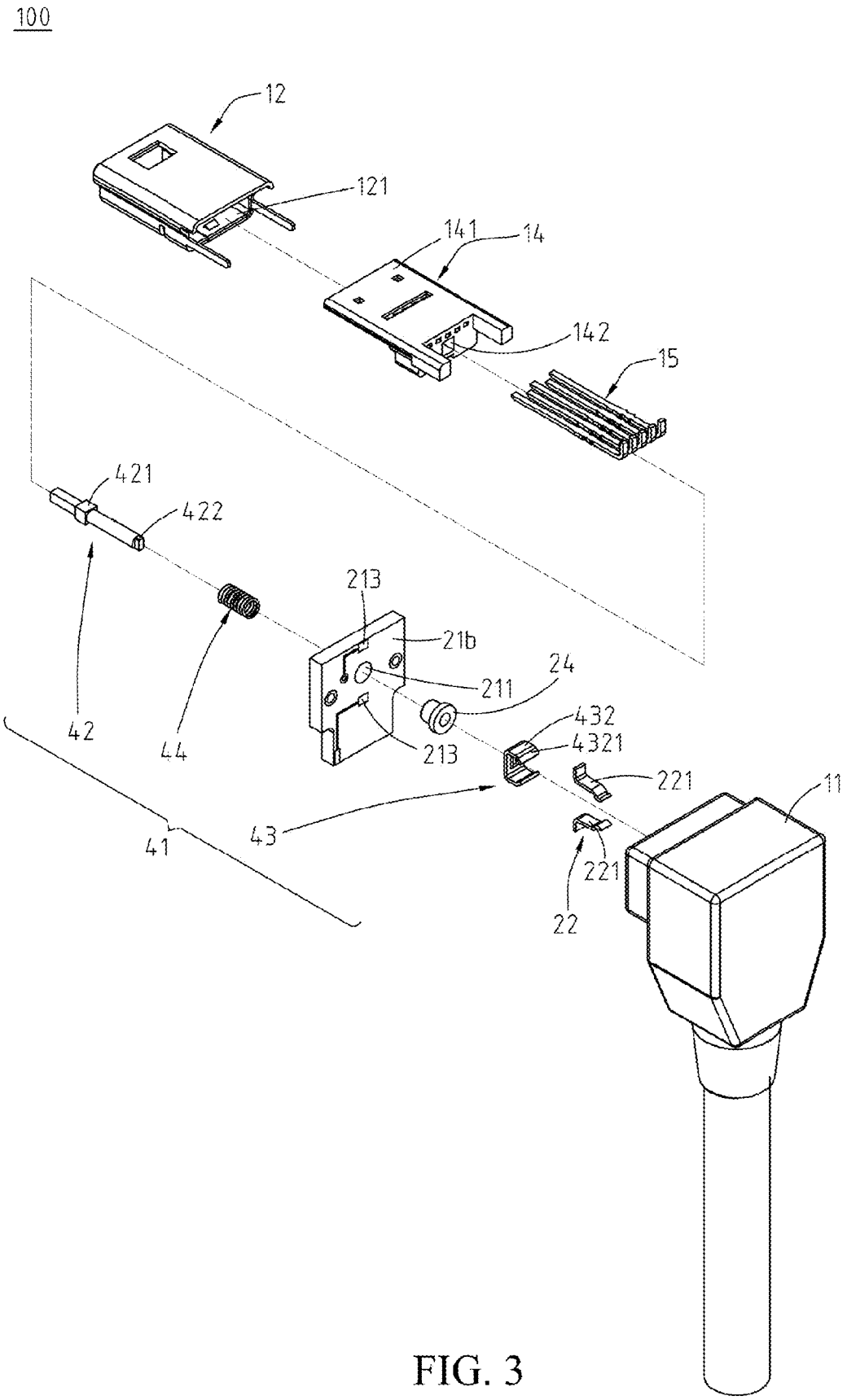
FIG. 3 is another exploded view of the electrical plug connector of the disclosure.

Please refer to FIGS. 1-3, which are respectively a perspective view, an exploded view, and another exploded view of an electrical plug connector 100. The electrical plug connector 100 can be a Mini USB connecting interface or a Micro USB connecting interface, but not limited thereto; the electrical plug connector 100 can an USB connecting interface, an HDMI connecting interface or other connecting interfaces. Here, the electrical plug connector 100 has a connecting cable for connecting to a vehicle charger (not shown), applied for charging tachograph devices, cameras, mobile phones or other electrical devices. In this embodiment, the electrical plug connector 100 is substantially consisting of a plug body 11, a circuit board 21 and a switching member 41.

Figure 4:
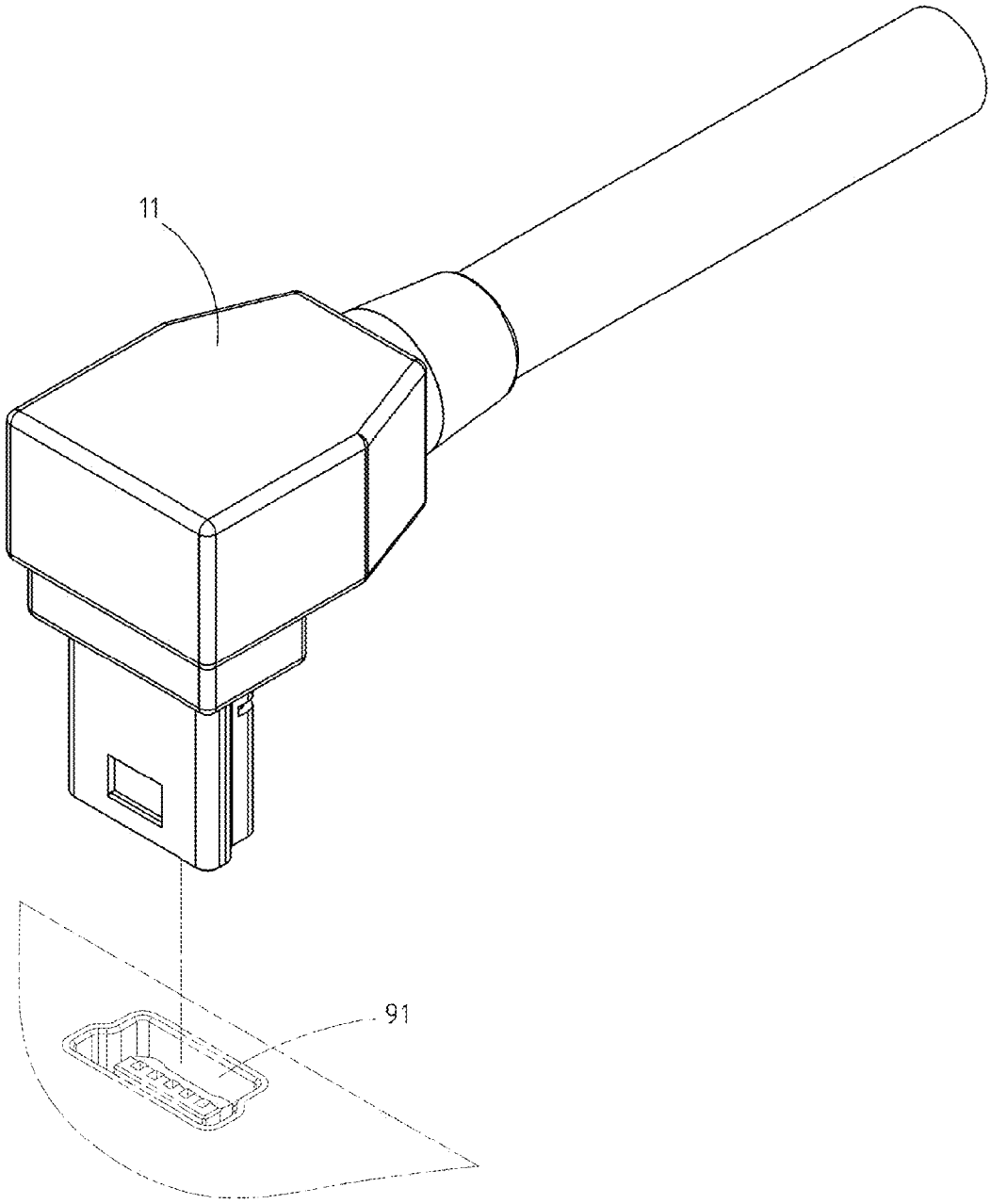
FIG. 4 is a perspective schematic view for showing the electrical plug connector of the disclosure is connecting to an electrical receptacle connector of an electrical device.
Figure 6:
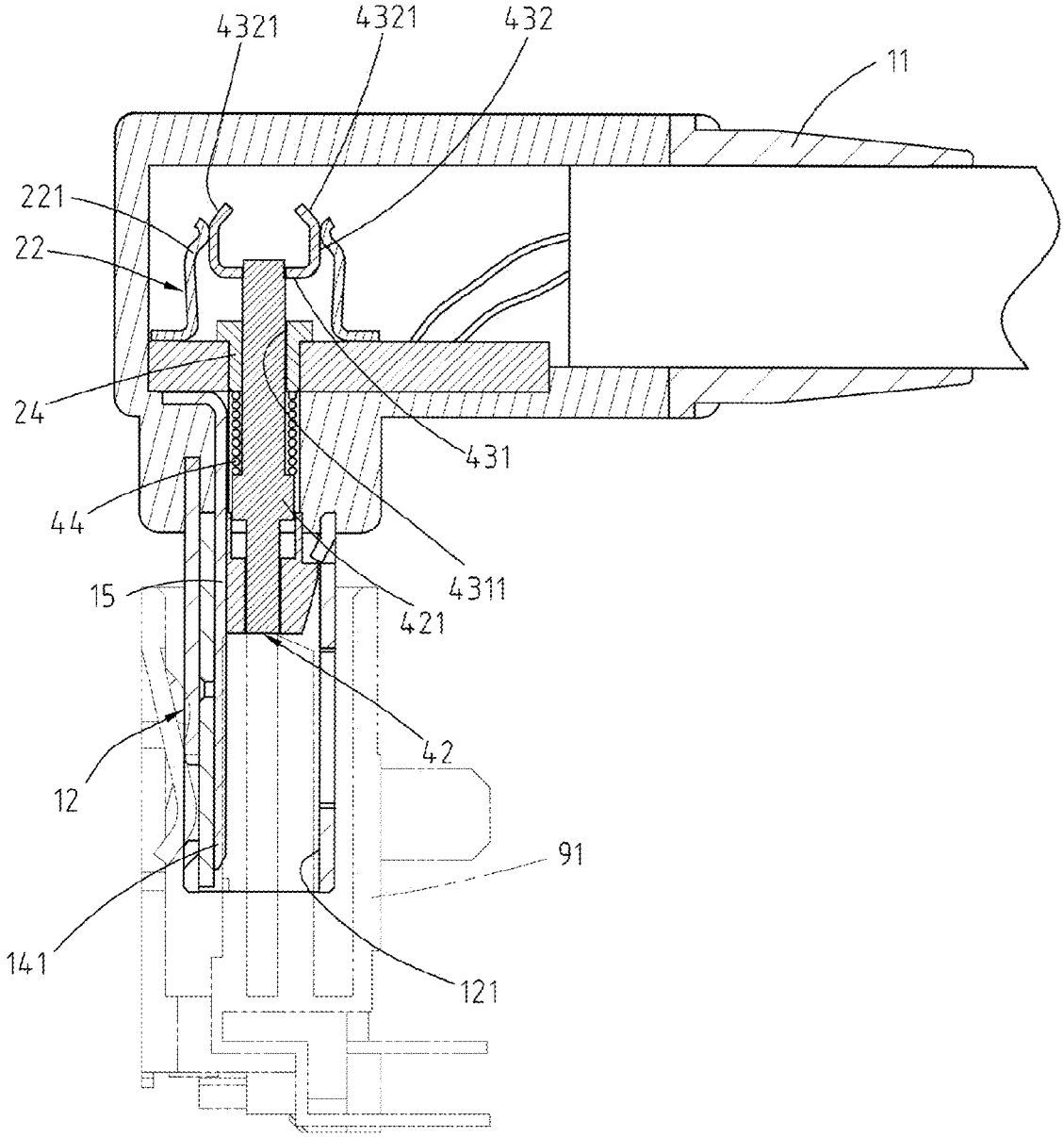
FIG. 6 is a cross-sectional schematic view for showing the electrical plug connector of the disclosure is connected to the electrical receptacle connector of the electrical device.

Please refer to FIGS. 2-4, in which the plug body 11 is an insulator made of plastic and one side thereof has a connecting shell 12. The plug body 11 and the connecting shell 12 can be combined via injection molding methods. Additionally, the connecting shell 12 is a metal shell, and an interior of the connecting shell 12 is formed as an inserting space 121 to connect with an electrical receptacle connector 91 (as shown in FIG. 6). In this embodiment, the connecting shell 12 is formed as the shape of the frame of the Mini USB connecting interface, but embodiments of the disclosure are not limited thereto. The connecting shell 12 has a terminal base 14 and a plurality of terminals 15 assembled therein. One side of the terminal base 14 has a tongue plate 141 extended therefrom. The terminals 15 are embeddingly assembled in the terminal base 14 and provided for transmitting electrical powers or signals. One side of each of the terminals 15 is disposed at the tongue plate 141, and another side of each of the terminals 15 is connected to a first face 21 a of the circuit board 21. Furthermore, the terminal base 14 has a positioning hole 142, and one end of a transmission bar 42 is inserted into and passing through the positioning hole 142.

Please refer to FIGS. 2-4, in which the circuit board 21 is disposed at the plug body 11 and vertical to the connecting shell 12. The circuit board 21 and the switching member 41 form a semi-finished product which is combined in the plug body 11 upon the plug body 11 being injected molded. The first face 21*a* of the circuit board 21 faces toward the inserting space 121, a second face 21*b* of the circuit board 21 is connected to a plurality of conductive plates 22. The first face 21*a* and the second face 21*b* of the circuit board 21 have a plurality of connecting points 213 for welding the terminals 15, the conductive plates 22 and the connecting cable.

Please refer to FIGS. 2-4, in which the switching member 41 is connected to the circuit board 21 and substantially consisting of the transmission bar 42, a contact plate 43 and an elastic member 44.

The transmission bar 42 is elongated and passing through the circuit board 21 so as to move relative to the circuit board 21. One end of the transmission bar 42 is protruded out of the first face 21*a* of the circuit board 21 so as to be disposed in the inserting space 121, and another end of the transmission bar 42 is protruded out of the second face 21*b* of the circuit board 21.

The contact plate 43 is a bent plate, and the lateral view of the contact plate 43 is U-shape profiled. The contact plate 43 is disposed adjacent to the conductive plates 22 and connected to another end of the transmission bar 42. Here, the contact plate 43 is disposed between two conductive plates 22 and is not contacted with the two conductive plates 22.

The elastic member 44 is a compressive spring. The elastic member 44 sleeves on the transmission bar 42 so as to be disposed between the terminal base 14 and the circuit board 21.

Figure 5:
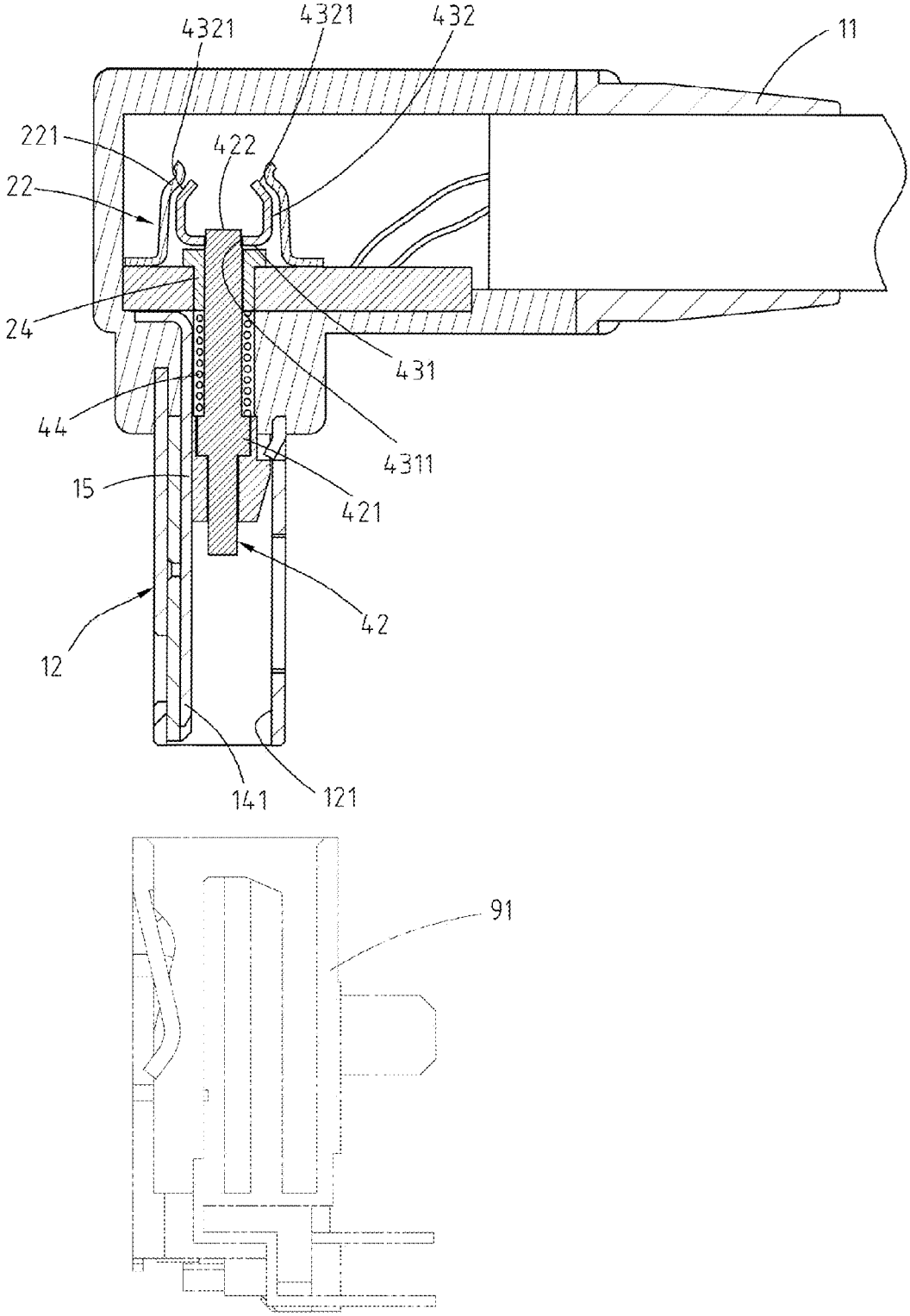
FIG. 5 is a cross-sectional schematic view for showing the electrical plug connector of the disclosure is connecting to the electrical receptacle connector of the electrical device.

Please refer to FIG. 4 and FIG. 5, in which when the electrical plug connector 100 is not connected with the electrical receptacle connector 91, the contact plate 43 is located between the two conductive plates 22 and is not contacted with the two conductive plates 22, so that the electrical plug connector 100 is in a disconnection state. Therefore, the short-circuit problem caused by spilling liquid on an electrified electrical plug connector 100 (namely, the connecting cable of the electrical plug connector 100 is electrified), can be prevented.

Please refer to FIGS. 4-6, in which when the electrical plug connector 100 is connected with the electrical receptacle connector 91 (namely, connected with the electrical device), a protruding plate of the electrical receptacle connector 91 is inserted into the inserting space 121, so that one end of the transmission bar 42 is abutted against the protruding plate so as to drive another end of the transmission bar 42 to move, and the contact plate 43 of another end of the transmission bar 42 is moved to connect with the conductive plates 22, so that the electrical plug connector 100 is in a connection state.

Please refer to FIGS. 2-4, in which the circuit board 21 further includes a through hole 211 and a stopping ring 24. The stopping ring 24 is disposed in the through hole 211 and sleeves out the transmission bar 42, so that the transmission bar 42 is moveable in the stopping ring 24. The stopping ring 24 is provided for waterproofing. In some implementation aspects, one end of the elastic member 44 is abutted against the stopping ring 24 or directly abutted against the circuit board 21, and another end of the elastic member 44 is connected to the transmission bar 42 and is compressed with the moving of the transmission bar 42.

Please refer to FIGS. 2-4, in which embodiment the transmission bar 42 further includes an annularly protruding block 421 assembled thereon. The outer diameter of the annularly protruding block 421 is larger than or equal to the outer diameter of the elastic member 44, one side of the annularly protruding block 421 is abutted against another end of the elastic member 44, another side of the annularly protruding block 421 is abutted against the positioning hole 142 of the terminal base 14.

Please refer to FIGS. 2-4, in which embodiment the contact plate 43 includes a plate member 431 and a plurality of lateral plates 432 extended from two sides of the plate member 431. In some implementation aspects, the plate member 431 includes a buckling hole 4311, one end of the transmission bar 42 includes an engaging block 422 buckled with the buckling hole 4311. Additionally, each of the conductive plates 22 further includes an elastic contact arm 221 formed thereon and disposed out of the lateral plates 432. The distance between the two elastic contact arms 221 is smaller than the distance between the two lateral plates 432. When the lateral plates 432 are moved and contacted with the elastic contact arms 221, the elastic contact arms 221 swing elastically and securely contacted with the lateral plates 432, as shown in FIG. 6.

Please refer to FIGS. 2-4, in which each of the lateral plates 432 has a guiding inclined plane 4321 formed thereon. The guiding inclined plane 4321 is adjacent to and parallel with the curved plane of the elastic contact arm 221. When the guiding inclined plane 4321 is contacted with the curve plane of the elastic contact arm 221, the guiding inclined plane 4321 guides the elastic contact arm 221 to move along the lateral plate 432 smoothly.

As described, when the electrical plug connector 100 is not connected with the electrical receptacle connector 91, the contact plate 43 of the switching member 41 is not contacted with the conductive plates 22 so that the electrical plug connector 100 is in the disconnection state, and the short-circuit problem does not occur upon spilling liquid on the electrical plug connector 100 in which the connecting cable thereof is electrified. Additionally, when the electrical receptacle connector 91 is inserting into the connecting shell 12, one end of the transmission bar 42 is abutted so as to drive the contact plate 43 of another end of the transmission bar 42 to connect with the conductive plates 22, so that the electrical plug connector 100 is in the connection state. Additionally, the stopping ring 24 is disposed in the through hole 211 of the circuit board 21 and sleeves with the transmission bar 42 so as to block water or liquid entering into the electrical plug connector 100 through the through hole 211 thereby providing a function of waterproofing.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a plug body, one side of the plug body comprising a connecting shell and an inserting space in the connecting shell;

a circuit board, disposing at the plug body, a first face of the circuit board facing toward the inserting space, a second face of the circuit board connecting to a plurality of conductive plates;

a switching member, connecting to the circuit board, comprising:

a transmission bar, passing through the circuit board, one end of the transmission bar protruded out of the first face of the circuit board so as to be disposed in the inserting space, another end of the transmission bar protruded out of the second face of the circuit board;

a contact plate, disposed adjacent to the conductive plates and connecting to another end of the transmission bar; and an elastic member, sleeving on the transmission bar;

wherein when an electrical receptacle connector is inserting into the connecting shell, one end of the transmission bar is abutted so as to drive another end of the transmission bar to move, so that the contact plate of another end of the transmission bar is connected with the conductive plates.

2. The electrical plug connector according to claim 1, wherein the circuit board comprises a through hole and a stopping ring, the stopping ring is disposed in the through hole to sleeve with the transmission bar.

3. The electrical plug connector according to claim 2, wherein one end of the elastic member is abutted against the stopping ring.

4. The electrical plug connector according to claim 3, wherein the transmission bar comprises an annularly protruding block abutted against another end of the elastic member.

5. The electrical plug connector according to claim 1, wherein the contact plate comprises a plate member and a plurality of lateral plates extended from two sides of the plate member, each of the conductive plates comprises an elastic contact arm disposed out of the lateral plates.

6. The electrical plug connector according to claim 5, wherein the plate member comprises a buckling hole, one end of the transmission bar comprises an engaging block buckled with the buckling hole.

7. The electrical plug connector according to claim 5, wherein each of the lateral plates comprises a guiding inclined plane contacted with the elastic contact arm.

8. The electrical plug connector according to claim 1, further comprising:

a terminal base, disposed at the connecting shell, comprising a tongue plate; and a plurality of terminals, one side of each of the terminals disposed at the tongue plate, another side of each of the terminals connected to the first face of the circuit board.

9. The electrical plug connector according to claim 8, wherein the terminal base comprises a positioning hole, one end of the transmission bar is passing through the positioning hole.

10. The electrical plug connector according to claim 1, wherein the second face of the circuit board comprises a plurality of connecting points connected to the conductive plates.

* * * * *